US008882900B2

(12) United States Patent
Arakawa et al.

(10) Patent No.: US 8,882,900 B2
(45) Date of Patent: Nov. 11, 2014

(54) SPIN FINISH FOR ELASTOMER FIBERS

(75) Inventors: Yasunobu Arakawa, Gamagori (JP); Jun Ito, Gamagori (JP)

(73) Assignee: Takemoto Yushi Kabushiki Kaisha, Gamagori-shi, Aichi-ken (JP)

( * ) Notice: Subject to any disclaimer, the term of this patent is extended or adjusted under 35 U.S.C. 154(b) by 225 days.

(21) Appl. No.: 13/459,819

(22) Filed: Apr. 30, 2012

(65) Prior Publication Data

US 2012/0291664 A1 Nov. 22, 2012

(30) Foreign Application Priority Data

May 16, 2011 (JP) ..... 2011/109069

(51) Int. Cl.

| | |
|---|---|
| ***C09D 4/00*** | (2006.01) |
| ***C09D 101/00*** | (2006.01) |
| ***C09D 201/00*** | (2006.01) |
| ***D21H 21/16*** | (2006.01) |
| ***D21H 17/07*** | (2006.01) |
| ***C09D 7/00*** | (2006.01) |
| ***D01F 11/08*** | (2006.01) |
| ***D06M 13/402*** | (2006.01) |
| ***D06M 13/418*** | (2006.01) |
| ***D06M 15/643*** | (2006.01) |
| ***D06M 23/08*** | (2006.01) |
| ***D01F 6/70*** | (2006.01) |
| ***D01F 6/94*** | (2006.01) |
| *D06M 101/38* | (2006.01) |

(52) U.S. Cl.

CPC ..... *D01F 11/08* (2013.01); *D06M 13/402* (2013.01); *D06M 13/418* (2013.01); *D06M 15/643* (2013.01); *D06M 23/08* (2013.01); *D01F 6/70* (2013.01); *D01F 6/94* (2013.01); *D06M 2101/38* (2013.01)

USPC ..... 106/285; 106/287.2; 106/287.25; 106/287.35

(58) Field of Classification Search

USPC ..... 106/285, 287.2, 287.25, 287.35

See application file for complete search history.

(56) References Cited

U.S. PATENT DOCUMENTS

| | | | | |
|---|---|---|---|---|
| 7,057,023 | B2 * | 6/2006 | Islam et al. | 530/412 |
| 2004/0102614 | A1 * | 5/2004 | Islam et al. | 530/353 |
| 2011/0034357 | A1 * | 2/2011 | Kawata et al. | 508/202 |

* cited by examiner

*Primary Examiner* — James McDonough

(74) *Attorney, Agent, or Firm* — Weaver Austin Villeneuve & Sampson LLP

(57) ABSTRACT

Spin finish having solid microparticles of a specified kind dispersed colloidally at a specified ratio in a dispersoid of a specified kind containing a smoothing agent component of a specified kind and a nitrogen-containing compound of a specified kind at specified ratios is for elastomer fibers such that packages having superior roll shape and unwinding property can be obtained in the production and fabrication process.

4 Claims, No Drawings

SPIN FINISH FOR ELASTOMER FIBERS

Priority is claimed on Japanese Patent Application 2011-109069, filed May 16, 2011.

BACKGROUND OF THE INVENTION

This invention relates to a spin finish for elastomer fibers. In the production and fabrication processes of elastomer fibers such as polyurethanes, it has been known to apply processing agents to the elastomer fibers in order to provide smoothness and antistatic property to the woven elastomers. This invention relates to a spin finish of this kind for elastomer fibers.

Examples of conventional spin finish of this kind for elastomer fibers include those having solid metallic soap dispersed in polydimethyl siloxane or mineral oil (such as disclosed in Japanese Patent Publications Tokko 41-286 and 40-5557 and Tokkai 9-217283), those containing polyoxyalkylene ether modified polysiloxane (such as disclosed in Japanese Patent Publication Tokkai 9-268477), and those containing polypropylene glycol polyols (such as disclosed in Japanese Patent Publication Tokkai 2000-327224). These prior art examples of spin finish for elastomer fibers have problems in that they involve serious troubles in the production or fabrication of polyurethane elastomer fibers such as inferior unwinding property of the package resulting in the production of the elastomer fibers and the inability to provide sufficient smoothness, antistatic property and adhesion with the hot melt adhesive.

SUMMARY OF THE INVENTION

It is therefore an object of this invention to provide a spin finish for elastomer fibers capable of providing a package having superior roll shape and unwinding property in the production of elastomer fibers and superior smoothness, antistatic property and adhesion with a hot melt adhesive to elastomer fibers such that elastomer fibers with high quality can be obtained under a condition with stable workability.

The inventors herein have completed the present invention by discovering, as a result of their research in view of the aforementioned object, that appropriately suitable spin finish for elastomer fibers can be obtained by dispersing solid microparticles of a specified kind in a colloidal form in a dispersoid of a specified kind containing a smoothing agent component of a specified kind and a nitrogen-containing compound of a specified kind at specified ratios.

DETAILED DESCRIPTION OF THE INVENTION

This invention relates to a spin finish for elastomer fibers, comprising Component A, Component B and Component C such that the component mass ratio between Component A and Component B is in the range of 100/0.01-100/5; that the component mass ratio between the sum of Component A and Component B and Component C (that is, ((component mass ratio of Component A)+(component mass ratio of Component B))/(component mass ratio of Component C)) is in the range of 100/0.01-100/10; that Component C is colloidally dispersed; that the spin finish has an average particle diameter in the range of 0.01-100 μm as measured by a specified measurement method; that Component A is a liquid containing a mineral oil in an amount of 50-100 mass % and silicone oil and/or ester oil in an amount of 0-50 mass % such that the total will be 100 mass %, and a viscosity of $2\times10^{-6}$-$1000\times10^{-6}$ $m^2/s$ at 25° C.; that Component B is one or more selected from the group consisting of nitrogen-containing compounds shown by Formula 1, nitrogen-containing compounds shown by Formula 2, nitrogen-containing compounds shown by Formula 3, and nitrogen-containing compounds shown by Formula 4, where Formula 1 is

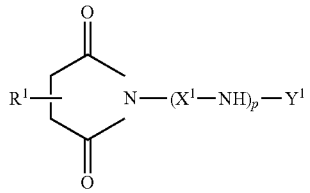

Formula 2 is

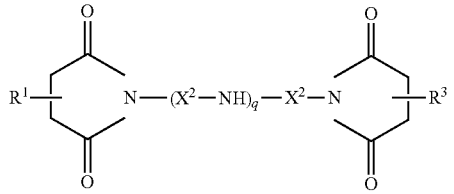

Formula 3 is

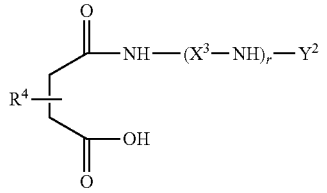

and Formula 4 is

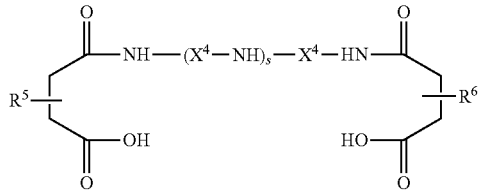

where p, q, r and s are each an integer 0-10, $R^1$-$R^6$ are each a residual group obtained by removing one hydrogen atom from an end of polyolefin with number averaged molecular weight of 200-8000, $X^1$-$X^4$ are each an alkylene group with 2-6 carbon atoms, $Y^1$ and $Y^2$ are each an alkyl group with 1-20 carbon atoms, alkenyl group with 1-20 carbon atoms, hydroxy alkyl group with 1-20 carbon atoms or hydrogen atom except that $Y^1$ and $Y^2$ are not hydrogen atom if p=0 or r=0; that Component C is solid microparticles of one or more kinds selected from oxides of silicon, oxides of metal atoms, carbonates of metal atoms and salts of metal atoms of aliphatic acid with 12-22 carbon atoms where these metal atoms are selected from the group consisting of Na, Mg, Ca, Ba, Zn, Ti and Al; and that the aforementioned specified measurement method comprises the steps of preparing a mixture by mixing polydimethyl siloxane and a mineral oil, both having viscosity of $10\times10^{-6}$ $m^2/s$ at 25° C., at mass ratio of 1/1; diluting the spin finish for elastomer fibers with this mixture such that the concentration of Component C in the spin finish becomes 1000 mg/L to thereby obtain a diluted liquid; and measuring the volume standard average particle diameter of this diluted liquid by using a laser scattering particle size distribution analyzer.

The spin finish for elastomer fibers according to this invention (hereinafter simply referred to as the spin finish of this invention) will be described first. The spin finish of this invention is for coating elastomer fibers when they are being produced or fabricated and is characterized, as explained above, comprising Components A, B and C which are specifically defined as above.

Examples of the mineral oil in Component A include general petroleum fractions comprised of paraffin component, naphthene component and aromatic component. Their component ratios are not specific but those with viscosity in the range of $2\times10^{-6}$-$100\times10^{-6}$ $m^2/s$ at 25° C. are preferable.

Examples of the silicone oil in Component A include (1) polydimethyl siloxanes with repetition units comprising dimethyl siloxane units, (2) polydialkyl siloxanes with repetition units comprising dimethyl siloxane units and dialkyl siloxane units with 2-4 carbon atoms, and (3) methylphenyl siloxanes with repetition units comprising dimethyl siloxane units and methylphenyl siloxane units. Among these, polydimethyl siloxanes are preferable.

Examples of the ester oil in Component A include (1) esters of aliphatic monovalent alcohol and aliphatic monocarboxylic acid such as butyl stearate, octyl stearate, oleyl laurate, oleyl oleate, isotridecyl stearate, and isopenthacosanyl isostearate, (2) esters of aliphatic polyvalent alcohol and aliphatic monocarboxylic acid such as 1,6-hexanediol didecanoate, trimethylol propane monooleate monolaurate, trimethylol propane trilaurate, and castor oil, and (3) esters of aliphatic monovalent alcohol and aliphatic polyvalent carboxylic acid such as dilauryl adipate and azelaic acid dioleyl. Among these, esters of aliphatic monovalent alcohol and aliphatic monocarboxylic acid such as octyl stearate and isotridecyl stearate with 15-40 total carbon atoms and esters of aliphatic polyvalent alcohol and aliphatic monocarboxylic acid such as trimethylol propane trilaurate and castor oil with 15-40 total carbon atoms are preferable.

Component A is a component containing mineral oil in an amount of 50-100 mass % and silicone oil and/or ester oil in an amount of 0-50 mass % (for a total of 100 mass %) but those containing mineral oil in an amount of 70-100 mass % and silicone oil and/or ester oil in an amount of 0-30 mass % (for a total of 100 mass %) are preferable, and those containing mineral oil in an amount of 70-90 mass % and silicone oil and/or ester oil in an amount of 10-30 mass % (for a total of 100 mass %) are ever more preferable. If the total content ratio of silicone oil and ester in Component A exceeds 50 mass %, adhesion with a hot melt adhesive and the scouring property are adversely affected to a significant degree.

Viscosity of Component A is $2\times10^{-6}$-$1000\times10^{-6}$ $m^2/s$ at 25° C. but those with viscosity in the range of $2\times10^{-6}$-$100\times10^{-6}$ $m^2/s$ are preferable. If the viscosity were less than $2\times10^{-6}$ $m^2/s$, the spin finish would tend to fly around when applied to elastomer fibers. If the viscosity were in excess of $1000\times10^{-6}$ $m^2/s$, on the other hand, the spin finish would not bring about good smoothness, even if applied to elastomer fibers. Viscosity, as referred to herein, is a value measured by a method using a Cannon-Finske viscometer according to JIS-K2283 (kinetic viscosity test method for petroleum product).

Component B to be used for a spin finish of this invention is each one or more selected from nitrogen-containing compounds shown by Formula 1, nitrogen-containing compounds shown by Formula 2, nitrogen-containing compounds shown by Formula 3, and nitrogen-containing compounds shown by Formula 4. These nitrogen-containing compounds are essential components for improving the scouring property and the adhesion with a hot melt adhesive. Aforementioned Component A may be used for the dilution of Component B.

$X^1$-$X^4$ in Formulas 1-4 are each an alkylene group with 2-6 carbon atoms. Examples of such alkylene group include ethylene group, propylene group, methylethylene group, tetramethylene group, 2-methylpropylene group, pentamethylene group, 2-methyltetramethylene group, hexamethylene group, and 2-methylpentamethylene group. Among these, alkylene groups with 2-4 carbon atoms such as ethylene group, propylene group, methylethylene group, tetramethylene group and 2-methylpropylene group are preferable.

$Y^1$ and $Y^2$ in Formulas 1 and 3 are each an alkyl group with 1-20 carbon atoms, alkenyl group with 1-20 carbon atoms, hydroxy alkyl group with 1-20 carbon atoms or hydrogen atom such as methyl group, ethyl group, ethenyl group, propyl group, propenyl group, isopropyl group, isopropenyl group, butyl group, butenyl group, isobutyl group, isobutenyl group, pentyl group, pentenyl group, isopentyl group, isopentenyl group, hexyl group, octyl group, nonyl group, decyl group, 2-methylheptyl group, dodecyl group, 2-methylundecyl group, tridecyl group, tetradecyl group, hexadecyl group, octadecyl group, eicosyl group, hydroxymethyl group, hydroxyethyl group, hydropropyl group, hydroxyisopropyl group, hydroxybutyl group, hydroxyisobutyl group, hydroxypentyl group, hydroxyhexyl group, hydroxyoctyl group, hydroxydecyl group, hydroxydodecyl group, hydroxytetradecyl group, hydroxyhexadecyl group, hydroxyoctadecyl group, hydroxyeicosyl group, and hydrogen atom. Among these, alkyl groups with 1-12 carbon atoms, alkenyl groups with 1-12 carbon atoms, hydroxyalkyl groups with 1-12 carbon atoms and hydrogen atom are preferable. Hydrogen atom is excluded, however, when p=0 or r=0 in Formula 1 and Formula 3.

In Formulas 1-4, p, q, r and s are each an integer 0-10 but integers 1-6 are preferable.

$R^1$-$R^6$ in Formulas 1-4 are each a residual group obtained by removing one hydrogen atom from an end of polyolefin with number averaged molecular weight of 200-8000 comprising polymers such as propene, butene, pentene, hexene and octene. Among the above, residual groups obtained by removing one hydrogen atom from an end of polyolefin with number averaged molecular weight of 500-5000 are preferable.

Component B is each one or more selected from nitrogen-containing compounds shown by Formula 1, nitrogen-containing compounds shown by Formula 2, nitrogen-containing compounds shown by Formula 3, and nitrogen-containing compounds shown by Formula 4. Among the above, nitrogen-containing compounds shown by Formula 1 and/or nitrogen-containing compounds shown by Formula 2 are preferable.

Component B can be obtained by a known method of synthesis and is not limited by its method of production. It is preferable from the point of view of power saving, however, to synthesize Component B by using the mineral oil used for Component A as the solvent for dilution and using it, as it is, as the modifier because the step of isolating Component B from the reacting system after its synthesis and the step of removing the organic solvent used for the purpose of dilution can be eliminated.

Component C to be used for a spin finish of this invention is solid microparticles of one or more kinds selected from oxides of silicon, oxides of metal atoms, carbonates of metal atoms and salts of metal atoms of aliphatic acid with 12-22 carbon atoms where the metal atoms are selected from the group consisting of Na, Mg, Ca, Ba, Zn, Ti and Al. Among the above, solid microparticles of magnesium salts of aliphatic acid with 12-22 carbon atoms and/or calcium salts of aliphatic acid with 12-22 carbon atoms are preferable.

Examples of oxide of silicon for Component C include silicon oxide and examples of oxides of metal atoms include sodium oxide, magnesium oxide, calcium oxide, barium oxide, zinc oxide, titanium oxide and aluminum oxide.

Examples of carbide of metal atoms for Component C include sodium carbide, magnesium carbide, calcium carbide, barium carbide and zinc carbide.

Examples of metal salt of aliphatic acid for Component C include sodium laurate, sodium myristate, sodium pulmitate, sodium stearate, sodium arachidate, sodium behenate, magnesium dilaurate, calcium dilaurate, zinc dilaurate, barium dilaurate, magnesium dimyristate, calcium dimyristate, zinc dimyristate, barium dimyristate, magnesium dipulmitate, calcium dipulmitate, zinc dipulmitate, barium dipulmitate, magnesium distearate, calcium distearate, zinc distearate, barium distearate, magnesium diarachidate, calcium diarachidate, zinc diarachidate, barium diarachidate, magnesium dibehenate, calcium behenate, zinc dibehenate, barium dibehenate, magnesium myristate pulmitate, calcium myristate pulmitate, zinc myristate pulmitate, barium myristate pulmitate, magnesium myristate stearate, calcium myristate stearate, zinc myristate stearate, barium myristate stearate, magnesium pulmitate stearate, calcium pulmitate stearate, zinc pulmitate stearate, barium pulmitate stearate, and aluminum tristearate. Among these, magnesium and calcium salts of aliphatic acid with 14-18 carbon atoms such as magnesium dimyristate, calcium dimyristate, magnesium dipulmitate, calcium dipulmitate, magnesium distearate, calcium distearate, magnesium myristate pulmitate, calcium myristate pulmitate, and their mixtures are preferable.

Components A, B and C to be used for the spin finish of this invention as explained above can be easily prepared by a known method.

The spin finish of this invention comprises Components A, B and C as explained above such that the ratio between the mass content ratio of Component A and the mass content ratio of Component B is in the range of 100/0.01-100/5, and more preferably in the range of 100/0.01-100/3. By arranging the ratio between the mass content ratios of Components A and B in this way, thixotropy of the spin finish of this invention can be adjusted to be appropriate such that the spin finish can be coated uniformly over elastomer fibers.

Moreover, the spin finish of this invention is characterized as containing Components A, B and C such that the ratio between the sum of the mass content ratios of Component A and Component B and the mass content ratio of Component C is in the range of 100/0.01-100/10, and more preferably in the range of 100/0.01-100/7. By adjusting this ratio in this manner, the roll shape of the package produced with the elastomer fibers can be maintained well.

The spin finish of the invention, furthermore, is a liquid in which the solid microparticles of Component C are colloidally dispersed. In other words, the spin finish of the invention is a liquid having a mixture of Components A and B as a dispersion medium in which the solid microparticles of Component C are dispersed at the mass ratio described above.

The spin finish of the invention is further characterized as having an average particle diameter in the range of 0.01-100 μm, and more preferably in the range of 0.1-30 μm, as measured by aforementioned specified measurement method.

By this specified measurement method, the spin finish of the invention is diluted by using a liquid mixture of polydimethyl siloxane and mineral, both having a viscosity of $10\times10^{-6}$ $m^2/s$ at 25° C., at mass ratio of 1/1 such that the concentration of Component C in the spin finish will become 1000 mg/L. This diluted liquid is then provided at the liquid temperature of 25° C. to a laser scattering particle size distribution analyzer to measure its volume standard average particle diameter. A laser scattering particle size distribution analyzer of LA-920 (trade name) produced by Horiba, Ltd., for example, may be used for this purpose.

When the spin finish of the invention is used, additional components may be used together, whenever necessary. Example of such additional components include: (1) modified silicone oils and silicone resins such as amino modified polydimethyl siloxane, polyether modified polydimethyl siloxane, carboxy modified polydimethyl siloxane, epoxy modified polydimethyl siloxane, mercapto modified polydimethyl siloxane, and alkyl modified polydimethyl siloxane; (2) compatibilizing agents such as non-ionic surfactants and higher alcohols; (3) antistatic agents such as ionic surfactants; and (4) other known agents for synthetic fibers such as wetting agents, ultraviolet absorbers, antioxidants, lubricants, antistatic agents, and antiseptic agents.

The spin finish of this invention need not be produced by any specified method and may be produced by any known method. For example, the spin finish of this invention may be produced first by mixing Components A, B and C at a specified ratio to prepare a mixture and then by providing this mixture to a wet crushing process to obtain the spin finish of this invention.

Examples of crusher that may be used for the aforementioned wet crushing process include known kinds of wet-type crushers such as vertical bead mills, horizontal bead mills, sand grinders and colloid mills. There is no particular limitation on the temperature at which the components should be mixed together and the wet crushing process should be carried out, but the temperature range of 20-35° C. is preferable.

Next, the method of processing elastomer fibers by using the spin finish of this invention (hereinafter referred to as the processing method of this invention) is explained. By the processing method of this invention, a spin finished of this invention as explained above is applied directly without diluting onto elastomer fibers by the so-called neat oiling method. A known method of application such as the roller oiling method, the guide oiling method and the spray oiling method may be used. There is no particular limitation regarding the amount of spin finish to be applied to the elastomer fibers but it is preferable to apply a spin finish of this invention in an amount of 0.1-10 mass % with respect to the elastomer fibers. There is no particular limitation on the form of the elastomer fibers. Application may be made to either filament-type elastomer fibers or spun elastomer fibers.

The processing method of this invention is particularly effective in the spinning process of elastomer fibers if a spin finish of this invention is applied to spun elastomer fibers. Examples of applicable spinning method include the dry spinning method, the molten spinning method, and the wet spinning method but it is preferable to apply to elastomer fibers that have been spun by the dry spinning method.

Lastly, elastomer fibers that have been processed by the processing method of this invention are explained. There is no limitation on the type of elastomer fibers such as polyester elastomer fibers, polyamide elastomer fibers, polyolefin elastomer fibers and polyurethane elastomer fibers, but the present invention is particularly effective in the case of polyurethane elastomer fibers.

According to the present invention, packages with superior roll shapes and unwinding property can be obtained by the production and fabrication of elastomer fibers. It also becomes possible to provide elastomer fibers with superior smoothness, antistatic property and adhesion with a hot melt adhesive. Thus, the present invention has the favorable effect of making it possible to obtain elastomer fibers with a high quality under stable workability.

EXAMPLES

In what follows, examples are provided for more clearly demonstrate the structure and effects of the invention but it is not intended that the invention is limited by these examples. In what follows, "part" will indicate "mass part" and "%" will indicate "mass %".

Part 1

Synthesis of Nitrogen-Containing Compounds of Component B

Synthesis of Nitrogen-Containing Compound (B-1) Shown by Formula 1

Triethylene tetraamine 100 g and mineral oil 863 g were added into a 2-liter glass reactor, into which polybutenyl succinic imide with number average molecular weight of the polybutene part 1500 800 g was gradually dropped under a nitrogen gas flow at 150° C. to cause a reaction for 2 hours. After the temperature was raised to 200° C. and the unreacting portion of triethylene tetraamine and the generated water were removed under reduced pressure, the temperature was lowered to 140° C. and polybutenyl succinate imide was synthesized by filtering. This is named nitrogen-containing compound (B-1).

Synthesis of Nitrogen-Containing Compounds (B-2), (B-5)-(B-7), (B-10) and (b-2)

Nitrogen-containing compounds (B-2), (B-5)-(B-7), (B-10) and (b-2) were synthesized similarly as nitrogen-containing compound (B-1).

Synthesis of Nitrogen-Containing Compound (B-3) Shown by Formula 2

Tripropylene tetraamine 47 g and mineral oil 814 g were added into a 2-liter glass reactor, into which polybutenyl succinic imide with number average molecular weight of the polybutene part 1500 799 g was gradually dropped under a nitrogen gas flow at 150° C. to cause a reaction for 2 hours. After the temperature was raised to 200° C. and the unreacting portion of triethylene tetraamine and the generated water were removed under reduced pressure, the temperature was lowered to 140° C. and polybutenyl succinate imide was synthesized by filtering. This is named nitrogen-containing compound (B-3).

Synthesis of Nitrogen-Containing Compounds (B-4), (B-8) and (B-9)

Nitrogen-containing compounds (B-4), (B-8) and (B-9) were synthesized similarly as nitrogen-containing compound (B-3).

Synthesis of Nitrogen-Containing Compound (B-11) Shown by Formula 3

After triethylene tetraamine 100 g and mineral oil 722 g were added into a 2-liter glass reactor and polybutenyl succinic imide with number average molecular weight of the polybutene part 1200 649 g was gradually dropped into it under a nitrogen gas flow at 120° C. to cause a reaction for 2 hours, polybutenyl succinate imide was synthesized by filtering. This is named nitrogen-containing compound (B-11).

Synthesis of Nitrogen-Containing Compounds (B-14), (B-15), (B-17)-(B-20), (b-1) and (b-3)

Nitrogen-containing compounds (B-14), (B-15), (B-17)-(B-20), (b-1) and (b-3) were synthesized similarly as nitrogen-containing compound (B-11).

Synthesis of Nitrogen-Containing Compound (B-12) Shown by Formula 4

After polybutenyl succinic imide with number average molecular weight of the polybutene part 3000 775 g, triethylene tetraamine 18 g and mineral oil 793 g were added into a 2-liter glass reactor to carry out a reaction under a nitrogen gas flow at 120° C. for 2 hours, polybutenyl succinate imide was synthesized by filtering. This is named nitrogen-containing compound (B-12).

Synthesis of Nitrogen-Containing Compounds (B-13) and (B-16)

Nitrogen-containing compounds (B-13) and (B-16) were synthesized similarly as nitrogen-containing compound (B-12).

Details of the nitrogen-containing compounds of Component B thus synthesized are shown together in Table 1.

TABLE 1

| Kind of nitrogen-containing compound of Component B | Corresponding chemical formula | Number average molecular weight of polyolefin in $R^1$-$R^6$ | $X^1$-$X^4$ | $Y^1$, $Y^2$ | p − s |
|---|---|---|---|---|---|
| B-1 | 1 | 1500 | Ethylene | Hydrogen atom | 3 |
| B-2 | 1 | 1500 | Ethylene | Hydrogen atom | 2 |
| B-3 | 2 | 1500 | Trimethylene | — | 3 |
| B-4 | 2 | 1500 | Trimethylene | — | 3 |
| B-5 | 1 | 4000 | Ethylene | Hydrogen atom | 3 |
| B-6 | 1 | 1500 | Ethylene | Ethyl group | 3 |

TABLE 1-continued

| Kind of nitrogen-containing compound of Component B | Corresponding chemical formula | Number average molecular weight of polyolefin in $R^1$-$R^6$ | $X^1$-$X^4$ | $Y^1$, $Y^2$ | p − s |
|---|---|---|---|---|---|
| B-7 | 1 | 900 | Trimethylene | Hydrogen atom | 2 |
| B-8 | 2 | 1500 | Ethylene | — | 5 |
| B-9 | 2 | 600 | Ethylene | — | 3 |
| B-10 | 1 | 1500 | Tetramethylene | Hydrogen atom | 3 |
| B-11 | 3 | 1200 | Ethylene | Hydrogen atom | 3 |
| B-12 | 4 | 3000 | Ethylene | — | 3 |
| B-13 | 4 | 3000 | Ethylene | — | 3 |
| B-14 | 3 | 400 | Ethylene | Hydrogen atom | 3 |
| B-15 | 3 | 6000 | Ethylene | Hydrogen atom | 3 |
| B-16 | 4 | 400 | Ethylene | — | 7 |
| B-17 | 3 | 400 | Ethylene | Hexadecyl group | 7 |
| B-18 | 3 | 400 | Ethylene | *1 | 0 |
| B-19 | 3 | 400 | Ethylene | *2 | 7 |
| B-20 | 3 | 400 | Hexamethylene | Hexadecyl group | 7 |
| b-1 | 3 | 10000 | Octamethylene | Hexadecyl group | 3 |
| b-2 | 1 | 100 | Hexamethylene | Hexadecyl group | 7 |
| b-3 | 3 | 6000 | Hexamethylene | Docosyl group | 12 |

In Table 1:
*1: Hydroxyethyl group
*2: 9-octadecenyl group

Part 2

Preparation of Spin Finish for Elastomer Fibers

Test Example 1

Preparation of Spin Finish (T-1)

Mixture (a mixture with viscosity $10\times10^{-6}$ $m^2/s$ at 25° C.) of mineral oil with viscosity $10\times10^{-6}$ $m^2/s$ at 25° C. ($m^{-1}$) 90 parts and polydimethyl siloxane with viscosity $10\times10^{-6}$ $m^2/s$ at 25° C. (p-1) 10 parts as Component A and nitrogen-containing compound (B-1) as shown in Table 1 as Compound B 5 parts for 100 parts of Component A were mixed and magnesium distearate (C-1) as Component C 1 part was further added for 100 parts of the mixture. After the mixture became uniform at temperature of 20-35° C., a horizontal bead mill was used to carry out a wet crushing process to prepare spin finish (T-1) for elastomer fibers having magnesium distearate (C-1) dispersed colloidally.

Test Examples 2-49 and Comparison Examples 1-11

Spin finishes (T-2)-(T-49) and (t-1)-(t-11) were prepared as spin finish (T-1) was prepared in Test Example 1. In the preparation of spin finish (t-3) in Comparison Example 3, however, the rise in viscosity during the wet crushing process was excessive and titanium oxide (C-3) could not be dispersed colloidally.

Details of spin finishes (T-1)-(T-49) and (t-1)-(t-11) thus prepared are shown together in Table 2-Table 5.

TABLE 2

| Test Example | Kind | Component A: Mineral oil Kind/% | Silicone Kind/% | Ester Kind/% | Viscosity ($\times10^{-6}$ $m^2/s$) |
|---|---|---|---|---|---|
| 1 | T-1 | m-1/90 | p-1/10 | —/0 | 10 |
| 2 | T-2 | m-1/95 | p-1/5 | —/0 | 10 |
| 3 | T-3 | m-1/90 | p-1/10 | —/0 | 10 |

TABLE 2-continued

| Test Example | Kind | Component A: Mineral oil Kind/% | Silicone Kind/% | Ester Kind/% | Viscosity ($\times10^{-6}$ $m^2/s$) |
|---|---|---|---|---|---|
| 4 | T-4 | m-1/90 | p-1/10 | —/0 | 10 |
| 5 | T-5 | m-1/85 | p-1/10 | es-1/5 | 10 |
| 6 | T-6 | m-1/90 | p-1/10 | —/0 | 10 |
| 7 | T-7 | m-2/90 | p-2/10 | —/0 | 20 |
| 8 | T-8 | m-1/75 | p-1/25 | —/0 | 10 |
| 9 | T-9 | m-1/90 | p-1/10 | —/0 | 10 |
| 10 | T-10 | m-3/90 | p-3/10 | —/0 | 5 |
| 11 | T-11 | m-1/90 | p-1/10 | —/0 | 10 |
| 12 | T-12 | m-1/100 | p-1/0 | —/0 | 10 |
| 13 | T-13 | m-1/100 | p-1/0 | —/0 | 10 |
| 14 | T-14 | m-1/100 | p-1/0 | —/0 | 10 |
| 15 | T-15 | m-1/100 | p-1/0 | —/0 | 10 |
| 16 | T-16 | m-1/100 | p-1/0 | —/0 | 10 |
| 17 | T-17 | m-1/100 | p-1/0 | —/0 | 10 |
| 18 | T-18 | m-2/100 | p-2/0 | —/0 | 20 |
| 19 | T-19 | m-1/100 | p-1/0 | —/0 | 10 |
| 20 | T-20 | m-3/100 | p-3/0 | —/0 | 5 |
| 21 | T-21 | m-1/100 | p-1/0 | —/0 | 10 |
| 22 | T-22 | m-1/60 | p-1/40 | —/0 | 10 |
| 23 | T-23 | m-1/55 | p-1/45 | —/0 | 10 |
| 24 | T-24 | m-1/60 | p-1/40 | —/0 | 10 |
| 25 | T-25 | m-1/55 | p-1/40 | es-2/5 | 10 |
| 26 | T-26 | m-1/60 | p-1/40 | —/0 | 10 |
| 27 | T-27 | m-1/65 | p-1/35 | —/0 | 10 |
| 28 | T-28 | m-2/60 | p-2/40 | —/0 | 20 |
| 29 | T-29 | m-1/60 | p-1/40 | —/0 | 10 |
| 30 | T-30 | m-1/60 | p-1/40 | —/0 | 10 |
| 31 | T-31 | m-1/60 | p-1/40 | —/0 | 10 |
| 32 | T-32 | m-1/50 | p-1/40 | es-1/10 | 10 |
| 33 | T-33 | m-1/60 | p-1/40 | —/0 | 10 |
| 34 | T-34 | m-1/60 | p-1/40 | —/0 | 10 |
| 35 | T-35 | m-1/55 | p-1/40 | es-2/5 | 10 |
| 36 | T-36 | m-1/60 | p-1/40 | —/0 | 10 |
| 37 | T-37 | m-1/60 | p-1/40 | —/0 | 10 |
| 38 | T-38 | m-4/60 | p-1/40 | —/0 | 200 |
| 39 | T-39 | m-4/60 | p-1/40 | —/0 | 200 |
| 40 | T-40 | m-1/60 | p-1/40 | —/0 | 10 |
| 41 | T-41 | m-1/60 | p-1/40 | —/0 | 10 |
| 42 | T-42 | m-1/60 | p-1/40 | —/0 | 10 |
| 43 | T-43 | m-4/60 | p-1/40 | —/0 | 200 |
| 44 | T-44 | m-4/60 | p-1/40 | —/0 | 200 |
| 45 | T-45 | m-4/60 | p-1/40 | —/0 | 200 |

TABLE 2-continued

| Test Example | Kind | Component A Mineral oil Kind/% | Silicone Kind/% | Ester Kind/% | Viscosity ($\times 10^{-6}$ $m^2/s$) |
|---|---|---|---|---|---|
| 46 | T-46 | m-4/60 | p-1/40 | —/0 | 200 |
| 47 | T-47 | m-4/60 | p-1/40 | —/0 | 200 |
| 48 | T-48 | m-4/60 | p-1/40 | —/0 | 200 |
| 49 | T-49 | m-5/60 | p-1/40 | —/0 | 500 |

TABLE 3

| Test Example | Kind | Component B Kind/*1 | Component C Kind/ diameter (μm)/*2 | Ratio of each component in processing agent (%) Component A | Component B | Component C |
|---|---|---|---|---|---|---|
| 1 | T-1 | B-1/1 | C-1/10/1 | 98.0 | 1.0 | 1.0 |
| 2 | T-2 | B-2/0.5 B-3/0.5 | C-1/10/1 | 98.0 | 1.0 | 1.0 |
| 3 | T-3 | B-4/0.5 | C-1/1/2 | 97.5 | 0.5 | 2.0 |
| 4 | T-4 | B-5/2 | C-1/10/5 | 93.3 | 1.9 | 4.8 |
| 5 | T-5 | B-1/0.1 | C-1/20/2 | 97.9 | 0.1 | 2.0 |
| 6 | T-6 | B-6/1 | C-1/10/0.1 | 98.9 | 1.0 | 0.1 |
| 7 | T-7 | B-7/1 | C-1/10/2 | 97.0 | 1.0 | 2.0 |
| 8 | T-8 | B-8/2 | C-1/0.5/2 | 96.1 | 1.9 | 2.0 |
| 9 | T-9 | B-1/2 | C-1/10/2 | 96.1 | 1.9 | 2.0 |
| 10 | T-10 | B-1/2 | C-2/10/2 | 96.1 | 1.9 | 2.0 |
| 11 | T-11 | B-9/2 | C-2/10/2 | 96.1 | 1.9 | 2.0 |
| 12 | T-12 | B-1/1 | C-1/10/1 | 98.0 | 1.0 | 1.0 |
| 13 | T-13 | B-2/0.5 B-3/0.5 | C-1/10/1 | 98.0 | 1.0 | 1.0 |
| 14 | T-14 | B-4/0.5 | C-1/1/2 | 97.5 | 0.5 | 2.0 |
| 15 | T-15 | B-5/2 | C-1/10/5 | 93.3 | 1.9 | 4.8 |
| 16 | T-16 | B-1/0.1 | C-1/20/2 | 97.9 | 0.1 | 2.0 |
| 17 | T-17 | B-6/1 | C-1/10/0.1 | 98.9 | 1.0 | 0.1 |
| 18 | T-18 | B-7/1 | C-1/10/2 | 97.0 | 1.0 | 2.0 |
| 19 | T-19 | B-8/2 | C-1/0.5/2 | 96.1 | 1.9 | 2.0 |
| 20 | T-20 | B-1/2 | C-2/10/2 | 96.1 | 1.9 | 2.0 |
| 21 | T-21 | B-9/2 | C-2/10/2 | 96.1 | 1.9 | 2.0 |
| 22 | T-22 | B-1/1 | C-2/10/1 | 98.0 | 1.0 | 1.0 |
| 23 | T-23 | B-2/0.5 B-3/0.5 | C-1/10/1 | 98.0 | 1.0 | 1.0 |
| 24 | T-24 | B-4/0.5 | C-1/1/2 | 97.5 | 0.5 | 2.0 |
| 25 | T-25 | B-5/2 | C-1/10/5 | 93.3 | 1.9 | 4.8 |
| 26 | T-26 | B-1/0.1 | C-1/25/2 | 97.9 | 0.1 | 2.0 |
| 27 | T-27 | B-6/1 | C-2/10/0.1 | 98.9 | 1.0 | 0.1 |
| 28 | T-28 | B-7/1 | C-1/10/2 | 97.0 | 1.0 | 2.0 |
| 29 | T-29 | B-8/2 | C-1/0.5/2 | 96.1 | 1.9 | 2.0 |
| 30 | T-30 | B-1/1 | C-3/10/1 | 98.0 | 1.0 | 1.0 |
| 31 | T-31 | B-1/2 | C-3/10/5 | 93.3 | 1.9 | 4.8 |
| 32 | T-32 | B-7/2 | C-3/10/2 | 96.1 | 1.9 | 2.0 |
| 33 | T-33 | B-1/1 | C-4/10/0.1 | 98.9 | 1.0 | 0.1 |
| 34 | T-34 | B-3/1 | C-3/50/1 | 98.0 | 1.0 | 1.0 |
| 35 | T-35 | B-5/2 | C-3/70/5 | 93.3 | 1.9 | 4.8 |
| 36 | T-36 | B-1/0.1 | C-5/50/2 | 97.9 | 0.1 | 2.0 |
| 37 | T-37 | B-1/1 | C-3/50/0.1 | 98.9 | 1.0 | 0.1 |
| 38 | T-38 | B-10/1 | C-6/10/1 | 98.0 | 1.0 | 1.0 |
| 39 | T-39 | B-7/2 | C-3/10/5 | 93.3 | 1.9 | 4.8 |
| 40 | T-40 | B-11/1 | C-3/10/1 | 98.0 | 1.0 | 1.0 |
| 41 | T-41 | B-12/2 | C-4/10/2 | 96.1 | 1.9 | 2.0 |
| 42 | T-42 | B-11/1 B-13/1 | C-4/10/2 | 96.1 | 1.9 | 2.0 |
| 43 | T-43 | B-14/1 | C-3/50/1 | 98.0 | 1.0 | 1.0 |
| 44 | T-44 | B-15/2 | C-3/50/2 | 96.1 | 1.9 | 2.0 |
| 45 | T-45 | B-16/1 | C-3/50/1 | 98.0 | 1.0 | 1.0 |
| 46 | T-46 | B-17/4 | C-6/40/5 | 91.5 | 3.7 | 4.8 |
| 47 | T-47 | B-18/4 | C-3/40/2 | 94.2 | 3.8 | 2.0 |
| 48 | T-48 | B-19/4 | C-3/40/2 | 94.2 | 3.8 | 2.0 |
| 49 | T-49 | B-20/4 | C-3/50/9 | 88.2 | 3.5 | 8.3 |

TABLE 4

| Comparison Example | Kind | Component A Mineral oil Kind/% | Silicone Kind/% | Ester Kind/% | Viscosity ($\times 10^{-6}$ $m^2/s$) |
|---|---|---|---|---|---|
| 1 | t-1 | m-4/20 | p-1/80 | —/0 | 200 |
| 2 | t-2 | m-4/60 | p-1/40 | —/0 | 200 |
| 3 | t-3 | m-4/60 | p-1/40 | —/0 | 200 |
| 4 | t-4 | m-4/60 | p-1/40 | —/0 | 200 |
| 5 | t-5 | m-4/60 | p-1/40 | —/0 | 200 |
| 6 | t-6 | m-1/60 | p-1/30 p-4/10 | —/0 | 1200 |
| 7 | t-7 | m-4/60 | p-1/40 | —/0 | 200 |
| 8 | t-8 | m-5/60 | p-1/40 | —/0 | 500 |
| 9 | t-9 | m-4/60 | p-1/40 | —/0 | 200 |
| 10 | t-10 | m-4/60 | p-1/40 | —/0 | 200 |
| 11 | t-11 | m-1/60 | p-1/30 p-4/10 | —/0 | 1200 |

TABLE 5

| Comparison Example | Kind | Component B Kind/*1 | Component C Kind/ diameter (μm)/*2 | Ratio of each component in processing agent (%) Component A | Component B | Component C |
|---|---|---|---|---|---|---|
| 1 | t-1 | B-14/4 | C-6/40/9 | 88.2 | 3.5 | 8.3 |
| 2 | t-2 | B-16/15 | C-4/70/1 | 86.1 | 12.9 | 1.0 |
| 3 | t-3 | B-14/5 | C-3/50/12 | 85.0 | 4.3 | 10.7 |
| 4 | t-4 | —/0 | C-3/50/9 | 91.7 | 0.0 | 8.3 |
| 5 | t-5 | B-16/4 | —/—/0 | 96.2 | 3.8 | 0.0 |
| 6 | t-6 | B-20/4 | C-3/50/9 | 88.2 | 3.5 | 8.3 |
| 7 | t-7 | b-1/4 | C-3/40/9 | 88.2 | 3.5 | 8.3 |
| 8 | t-8 | b-2/4 | C-4/50/9 | 88.2 | 3.5 | 8.3 |
| 9 | t-9 | b-3/4 | C-3/50/9 | 88.2 | 3.5 | 8.3 |
| 10 | t-10 | b-4/4 | C-3/200/9 | 88.2 | 3.5 | 8.3 |
| 11 | t-11 | —/0 | C-1/50/9 | 91.7 | 0.0 | 8.3 |

In Table 2-Table 5:

Kind: Kind of spin finish for elastomers

*1: Mass part of Component B per 100 parts of Component A

*2: Mass part of Component C per 100 parts of sum of Component A and Component B m-1: Mineral oil with viscosity $10\times10^{-6}$ $m^2/s$ at 25° C.

m-2: Mineral oil with viscosity $20\times10^{-6}$ $m^2/s$ at 25° C.

m-3: Mineral oil with viscosity $5\times10^{-6}$ $m^2/s$ at 25° C.

m-4: Mineral oil with viscosity $220\times10^{-6}$ $m^2/s$ at 25° C.

m-5: Mineral oil with viscosity $220\times10^{-6}$ $m^2/s$ at 25° C.

p-1: polydimethyl siloxane with viscosity $10\times10^{-6}$ $m^2/s$ at 25° C.

p-2: polydimethyl siloxane with viscosity $20\times10^{-6}$ $m^2/s$ at 25° C.

p-3: polydimethyl siloxane with viscosity $5\times10^{-6}$ $m^2/s$ at 25° C.

p-4: polydimethyl siloxane with viscosity $10000\times10^{-6}$ $m^2/s$ at 25° C.

es-1: 2-ethylhexyl stearate es-2: isotridecyl stearate

B-1-B-20, b-1-b-3: Components B described in Table 1

C-1: Magnesium distearate

C-2: Calcium distearate

C-3: Titanium oxide

C-4: Zinc oxide

C-5: Silicon oxide

C-6: Magnesium oxide

Part 3

Processing Tests on Polyurethane Elastomer Fibers after Wet Spinning

Tests Examples 50-98 and Comparison Examples 12-24

Polymer solution (A) was obtained by polymerizing N,N'-dimethylacetoamide (hereinafter referred to as DMAc) solution (concentration 35%) obtained from polyurethane base material comprising tetramethyleneetherglycol with molecular weight of 2900, bis-(p-isocyanate phenyl)-methane and ethylene diamine.

Next, a DMAc solution (concentration 35%) of a 2-to-1 (mass ratio) mixture of polyurethane (Methacrol 2462 (registered trademark) of E.I.duPont de Nemours & Company (Inc)) obtained by reacting t-butyldiethanolamine and methylene-bis-(4-cyclohexyl isocyanate) and condensation polymer of p-cresol and divinyl benzene (Methacrol 2390 (registered trademark) of E.I.duPont de Nemours & Company (Inc)) and defined as additive solution (B).

Aforementioned polymer solution (A) 96 parts and aforementioned additive solution (B) 4 parts were uniformly mixed together to obtain a spinning liquid.

The spinning liquid thus prepared was used to spin polyurethane elastomer fibers of 560 dtex comprising 56 single yarns by the dry spinning method, and the processing agents shown in Table 6 and Table 7 were applied directly without dilution in the neat condition from an oiling roller in a roller oiling process before the winding-up. The fibers subjected to the roller oiling process were wound up around a cylindrical paper tube of length 115 mm at a wind-up speed of 500 m/minute by using a winding machine with a surface drive through a traverse guide proving a wound width of 104 mm. Wound packages (1 kg and 3 kg) of polyurethane elastomer fibers were thus obtained by the dry spinning method. The amount of coated processing agent was adjusted by adjusting the number of rotations of the oiling roller.

Part 4

Evaluation of Processed Polyurethane Elastomer Fibers

Packages of polyurethane elastomer fibers obtained by the dry spinning method in Part 3 were measured and evaluated as follows and the results are shown together in Table 6 and Table 7.

Measurement of Coated Amount

Measurements were made of polyurethane elastomer fibers pulled out of the aforementioned package (1 kg) by a method according to JIS-L1073 (method of testing synthetic fiber filament yarns) by using normal hexane as extraction solvent.

Evaluation of Yarn Breakage

Yarn breakage frequency of the polyurethane elastomer fibers of Part 3 was measured at the time of the spinning and the spinning characteristic was evaluated as follows by measuring the wind-up distance per yarn breakage:

A: 5000 km or over;

B: 4500 km or over and less than 5000 km;

C: 4000 km or over and less than 4500 km;

D: Less than 4000 km.

Evaluation of Roll Shape

The maximum value ($W_{max}$) and the minimum value ($W_{min}$) of the wound width of the aforementioned package (1 kg) were measured, and the bulge was calculated from their difference ($W_{max}-W_{min}$) and evaluated as follows:

A: Bulge is less than 4 mm;

B: Bulge is 4-6 mm;

C: Bulge is 6-7 mm;

D: Bulge exceeds 7 mm.

Evaluation of Unwinding Property

A feeding part was formed on one side with a first driver roller and a first idler roller which remains in contact with it, a wind-up part was formed on the opposite side with a second driver roller and a second idler roller which remains in contact with it, and the wind-up part was set horizontally separated from the feeding part by 20 cm. A package (3 kg) similar to the aforementioned package was set to the first driver roller and was wound up on the second driver roller. While the feeding speed of the polyurethane elastomer fibers from the first driver roller was fixed to 50 m/minute, the wind-up speed of the polyurethane elastomer fibers to the second driver roller was gradually increased from 50 m/minute to forcibly unwind the polyurethane elastomer fibers from the package. During this forced unwinding, the wind-up speed V(m/minute) was measured at the moment when there is no free motion of the polyurethane elastomer fibers between the feeding part and the wind-up part, and the unwinding property (%) was obtained as follows:

$$\text{Unwinding property (\%)}=(V-50)\times 2$$

and was evaluated as follows:

A: Unwinding property is less than 120% (there is no problem and unwinding can be effected stably);

B: Unwinding property is 120% or over and less than 160% (there is some resistance when the yarn is pulled out but there is no yarn breakage and unwinding can be effected stably);

C: Unwinding property is 160% or over and less than 200% (there is resistance when the yarn is pulled out and there are some yarn breakages such that there is some problem in the operation);

D: Unwinding property is 200% or over (there is big resistance when the yarn is pulled out and there are frequent yarn breakages such that there is a big problem in the operation).

Similar evaluations were carried out on packages which have been left for 6 months at 25° C.

Evaluation of Smoothness

A friction measurement meter (SAMPLE FRICTION UNIT MODEL TB-1 (tradename) produced by Eiko Sokki Co., Ltd.) was used, a rough pin plated with chromium with diameter 1 cm and surface roughness 2S was disposed between its two free rollers, and the polyurethane elastomer fibers pulled out of the aforementioned package (1 kg) was arranged such that the contact angle with this rough pin would be 90 degrees. Under the condition of 25° C. and 60% RH, an initial tension ($T_1$) of 5 g was applied on the inlet side and the secondary tension ($T_2$) on the exit side was measured when the fibers were run at the speed of 100 m/minute. The coefficient of friction was calculated as follows:

$$\text{Coefficient of friction}=(2/3.14)\times\ln(T_2/T_1)$$

and was evaluated as follows:

A: Coefficient of friction was 0.150 or over and less than 0.220;

B: Coefficient of friction was 0.220 or over and less than 0.260;

C: Coefficient of friction was 0.260 or over and less than 0.300;

D: Coefficient of friction was 0.300 or over.

Similar evaluations were carried also on packages left for 6 months at 25° C.

Evaluation of Antistatic Property

When the aforementioned evaluation of smoothness was carried out, a static potential sensor (KSD-0103 (tradename) produced by Kasuga Electric Works, Ltd.) was placed at the position 1 cm below the rough pin plated with chromium. The generated voltage was measured and evaluated as follows:

A: Generated voltage was less than 50V (there was no problem at all and safe operation was possible);

B: Generated voltage was 50V or over and less than 100V (some filament dancing during the warping process but there was no problem and safe operation was possible);

C: Generated voltage was 100V or over and less than 500V (there was filament dancing during the warping process and there were problems although operation was possible);

D: Generated voltage was 500V or over (there was significant filament dancing during the warping process and the attachment of cotton fly was significant during the circle knitting such that operation was not possible).

Evaluation of Scum Resistance

Ten of aforementioned packages (1 kg) were set to a miniature warper in the style of a warper and fibers were wound up for a length of 500 km at the yarn speed of 100 m/minute under the condition of 25° C. and 65% RH. The conditions of scum falling off and being accumulated at the comb-shaped guide of the miniature warper at this operation were visually observed and evaluated as follows:

A: Hardly any scum attached;

B: Some attachment of scum but there was no problem in the sable running of the yarn;

C: Significant attachment and accumulation of scum such that there was some problem in the stable running of the yarn;

D: Extremely significant attachment and accumulation of scum such that there was significant problem in the stable running of the yarn.

Evaluation of Adhesion Property

A spunbond nonwoven fabric made of polypropylene was uniformly coated with rubber hot melt adhesive with styrene butadiene styrene copolymer as principal component heated and melted at 145° C. by using a roller and was cut to produce two cut sheets of size 40 mm×20 mm. A front end part 10 mm of the portion with length 40 mm of the polyurethane elastomer fibers pulled out of the aforementioned package (1 kg) was sandwiched between the surfaces of these two cut sheets coated with an adhesive and pressed for 30 seconds at the processing temperature of 160° C. and with a pressure of 9 g/cm$^2$ to obtain a sample. The polypropylene spunbond nonwoven fabric portion of this sample was affixed to the upper sample holding part of a tensile tester (Autograph AGS (tradename) produced by Shimadzu Corporation) while the polyurethane elastomer fibers were affixed to its lower sample holding part, and they were pulled at the speed of 100 mm/minute to measure the strength required for pulling out the polyurethane elastomer fibers from the polypropylene spunbond nonwoven fabric. The results were evaluated as follows:

A: Force was 35 g or over (hot melt adhesion is strong and stable operation is possible);

B: Force was 30 g or over and less than 35 g (hot melt adhesion is practical and no problem occurs in the operation);

C: Force was 25 g or over and less than 30 g (there is some problem with hot melt adhesion and problems sometimes occur in the operation);

D: Force is less than 25 kg (hot melt adhesion is weak and there are big problems in the operation).

Evaluation of Scouring Property

A woven fabric was produced from the aforementioned package (1 kg) of polyurethane elastomer fibers and nylon yarn by a warp knitting process. Two 5 cm×5 cm square sheets were cut out of this fabric and the attached quantity $OPU_1$ (mass %) of spin finish for elastomer fibers was measured by using one of them. For the other, a scouring agent (Pitchrun (tradename) produced by Nicca Chemical Co., Ltd.) was used for scouring at bath ratio of 1/20. After it was dried, the attached quantity $OPU_2$ (mass %) of spin finish for elastomer fibers was similarly measured. In the above, the measurements of the attached quantities ($OPU_1$ and $OPU_2$) are taken by a method according to JIS-L1073 (Test method of synthetic fiber filament yarns) by using normal hexane as extraction solvent. Residual ratio of the spin finishes for elastomer fibers was obtained as follows:

$$\text{Residual ratio}=(OPU_2)/(OPU_1)\times 100$$

and evaluated as follows:

A: Residual ratio is less than 30%;

B: Residual ratio is 30% or over and less than 40%;

C: Residual ratio is 40% or over and less than 50%;

D: Residual ratio is 50% or over.

As can be clearly understood from the results shown in Table 6 and Table 7, it is possible to obtain packages having superior roll shape and unwinding property at the time of production and fabrication of elastomer fibers if a processing agent and a processing method of this invention are used. It is also possible to provide superior smoothness, antistatic property and adhesion property with hot melt adhesives to elastomer fibers such that as a result it becomes possible to obtain elastomer fibers with a high quality under a condition of stable workability.

TABLE 6

| TE | Kind | *1 | *2 | *3 | *4 | *5 | *6 | *7 | *8 | *9 | *10 | *11 |
|---|---|---|---|---|---|---|---|---|---|---|---|---|
| 50 | T-1 | 4 | A | A | A | A | A | A | A | A | A | A |
| 51 | T-2 | 4 | A | A | A | A | A | A | A | A | A | A |
| 52 | T-3 | 4 | A | A | A | A | A | A | A | A | A | A |
| 53 | T-4 | 2 | A | A | A | A | A | A | A | A | A | A |
| 54 | T-5 | 4 | A | A | A | A | A | A | A | A | A | A |
| 55 | T-6 | 6 | A | A | A | A | A | A | A | A | A | A |
| 56 | T-7 | 4 | A | A | A | A | A | A | A | A | A | A |
| 57 | T-8 | 4 | A | A | A | A | A | A | A | A | A | A |
| 58 | T-9 | 3 | A | A | A | A | A | A | A | A | A | A |
| 59 | T-10 | 3 | A | A | A | A | A | A | A | A | A | A |
| 60 | T-11 | 3 | A | A | A | A | A | A | A | A | A | A |
| 61 | T-12 | 4 | A | A | A | A | A | B-A | A | A | A | A |
| 62 | T-13 | 4 | A | A | A | A | A | B-A | A | A | A | A |
| 63 | T-14 | 4 | A | A | A | A | A | B-A | A | A | A | A |
| 64 | T-15 | 2 | A | A | A | A | A | B-A | A | A | A | A |
| 65 | T-16 | 4 | A | A | A | A | A | B-A | A | A | A | A |
| 66 | T-17 | 6 | A | A | A | A | A | B-A | A | A | A | A |
| 67 | T-18 | 4 | A | A | A | A | A | B-A | A | A | A | A |

TABLE 6-continued

| TE | Kind | *1 | *2 | *3 | *4 | *5 | *6 | *7 | *8 | *9 | *10 | *11 |
|---|---|---|---|---|---|---|---|---|---|---|---|---|
| 68 | T-19 | 4 | A | A | A | A | A | B-A | A | A | A | A |
| 69 | T-20 | 3 | A | A | A | A | A | B-A | A | A | A | A |
| 70 | T-21 | 3 | A | A | A | A | A | B-A | A | A | A | A |
| 71 | T-22 | 4 | A | A | A | A | A | A | B | A | B | B |
| 72 | T-23 | 4 | A | A | A | A | A | A | B | A | B | B |
| 73 | T-24 | 4 | A | A | A | A | A | A | B | A | B | B |
| 74 | T-25 | 2 | A | A | A | A | A | A | B | A | B | B |
| 75 | T-26 | 6 | A | A | A | A | A | A | B | A | B | B |
| 76 | T-27 | 3 | A | A | A | A | A | A | B | A | B | B |
| 77 | T-28 | 4 | A | A | A | A | A | A | B | A | B | B |
| 78 | T-29 | 4 | A | A | A | A | A | A | B | A | B | B |
| 79 | T-30 | 4 | A | A | A | B | A | A | B | A | B | B |
| 80 | T-31 | 7 | A | A | A | B | A | A | B | A | B | B |
| 81 | T-32 | 4 | A | A | A | B | A | A | B | A | B | B |
| 82 | T-33 | 4 | A | A | A | B | A | A | B | A | B | B |
| 83 | T-34 | 4 | A | A | B | B | A | A | B | A | B | B |
| 84 | T-35 | 7 | A | A | B | B | A | A | B | A | B | B |
| 85 | T-36 | 4 | A | A | B | B | A | A | B | A | B | B |
| 86 | T-37 | 4 | A | A | B | B | A | A | B | A | B | B |
| 87 | T-38 | 4 | A | A | B | B | A | B | B | A | B | B |
| 88 | T-39 | 4 | A | A | B | B | A | B | B | A | B | B |
| 89 | T-40 | 4 | B | A | A | B | A | B | B | A | B | B |
| 90 | T-41 | 4 | B | A | A | B | A | B | B | A | B | B |
| 91 | T-42 | 4 | B | A | A | B | A | B | B | A | B | B |
| 92 | T-43 | 2 | B | A | B | B | A | B | B | A | B | B |
| 93 | T-44 | 7 | B | A | B | B | A | B | B | A | B | B |
| 94 | T-45 | 2 | B | A | B | B | A | B | B | B | B | B |
| 95 | T-46 | 4 | B | A | B | B | B | B | B | B | B | B |
| 96 | T-47 | 4 | B | A | B | B | B | B | B | B | B | B |
| 97 | T-48 | 4 | B | A | B | B | B | B | B | B | B | B |
| 98 | T-49 | 4 | B | B | B | B | B | B | B | B | B | B |

TABLE 7

| CE | Kind | *1 | *2 | *3 | *4 | *5 | *6 | *7 | *8 | *9 | *10 | *11 |
|---|---|---|---|---|---|---|---|---|---|---|---|---|
| 12 | — | — | D | D | D | D | D | D | C | C | A | A |
| 13 | t-1 | 5 | B | B | B | B | B | B | C | B | D | D |
| 14 | t-2 | 6 | D | D | A | A | A | B | B | B | B | B |
| 15 | t-3 | — | D | D | B | B | A | B | B | D | D | D |
| 16 | t-4 | 5 | B | B | B | B | B | B | B | D | D | D |
| 17 | t-5 | 4 | B | A | D | D | A | B | B | A | B | B |
| 18 | t-6 | 4 | D | D | B | B | C | C | B | C | B | B |
| 19 | t-7 | 4 | D | B | A | B | B | B | B | C | C | C |
| 20 | t-8 | 4 | B | B | C | D | B | B | B | C | B | B |
| 21 | t-9 | 4 | D | D | B | B | B | B | B | C | C | C |
| 22 | t-10 | 4 | D | D | C | C | B | B | B | C | C | C |
| 23 | t-11 | 4 | D | B | A | A | A | A | B | B | D | D |
| 24 | t-12 | 4 | B | B | C | C | D | C | B | B | A | A |

In Table 6 and Table 7:

TE: Test Example

CE: Comparison Example

Kind: Kind of spin finish for elastomer fibers

*1: Coated amount (%)

*2: Yarn breakage

*3: Roll shape

*4: Unwinding property

*5: Unwinding property after 6 months

*6: Smoothness

*7: Smoothness after 6 months

*8: Antistatic property

*9: Scum resistance

*10: Adhesiveness

*11: Scouring property

Comparison Example 12: Example where spin finish for elastomer fibers was not used T-1-T-49, t-1-t-11: Spin finishes for elastomer fibers described in Table 2-Table 5 t-12: Polypropylene glycol type polyol with average molecular weight of 400

What is claimed is:

1. A spin finish for elastomer fibers, said spin finish comprising Component A, Component B and Component C;

wherein the component mass ratio between Component A and Component B is in the range of 100/0.01-100/5;

wherein the component mass ratio between the sum of Component A and Component B and Component C is in the range of 100/0.01-100/10;

wherein Component C is colloidally dispersed;

wherein said spin finish has an average particle diameter in the range of 0.01-100 μm as measured by a specified measurement method;

wherein Component A is a liquid containing a mineral oil in an amount of 70-100 mass % and silicone oil and/or ester oil in an amount of 0-30 mass % such that the total will be 100 mass %, and a viscosity of $2\times10^{-6}$-$100\times10^{-6}$ $m^2/s$ at 25° C.;

wherein Component B is a compound shown by Formula 1, where Formula 1 is

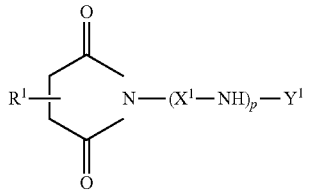

where $R^1$ is a residual group obtained by removing one hydrogen atom from an end of polyolefin with number averaged molecular weight of 500-5000, $X^1$ is an alkylene group with 2-4 carbon atoms, $Y^1$ is an alkyl group with 1-12 carbon atoms, an alkenyl group with 1-12 carbon atoms, a hydroxy alkyl group with 1-12 carbon atoms or hydrogen atom, and p is an integer 1-6;

wherein Component C is solid microparticles of one or more kinds selected from magnesium salt of aliphatic acid with 12-22 carbon atoms and calcium salt of aliphatic acid with 12-22 carbon atoms; and wherein said specified measurement method comprises the steps of:

preparing a mixture by mixing polydimethyl siloxane and a mineral oil, both having viscosity of $10\times10^{-6}$ $m^2/s$ at 25° C., at mass ratio of 1/1;

diluting said spin finish for elastomer fibers with said mixture such that the concentration of Component C in said spin finish becomes 1000 mg/L to thereby obtain a diluted liquid; and measuring the volume standard average particle diameter of said diluted liquid by using a laser scattering particle size distribution analyzer.

2. The spin finish of claim 1 wherein the component mass ratio between Component A and Component B is in the range of 100/0.01-100/3; and wherein the component mass ratio between the sum of Component A and Component B and Component C is in the range of 100/0.01-100/7.

3. The spin finish of claim 1 having an average particle diameter in the range of 0.1-30 μm.

4. The spin finish of claim 2 having an average particle diameter in the range of 0.1-30 μm.

* * * * *